US008614614B2

(12) United States Patent
Navarro et al.

(10) Patent No.: US 8,614,614 B2
(45) Date of Patent: Dec. 24, 2013

(54) SUBMERSIBLE DRY DISTRIBUTION TRANSFORMER

(75) Inventors: Martin Alsina Navarro, Jundiaí (BR); Jose Carlos Medeiros, Campinas (BR); Eledilson Clayton Betiol, Campinas (BR); Marilucia Martinato, Jundiaí (BR); Renan Junqueira Dias, Lambari (BR); Jean Carlos da Silva, Várzea Paulista (BR)

(73) Assignee: Siemens Ltda., Sao Paulo (BR)

( * ) Notice: Subject to any disclaimer, the term of this patent is extended or adjusted under 35 U.S.C. 154(b) by 0 days.

(21) Appl. No.: 13/321,361

(22) PCT Filed: May 18, 2010

(86) PCT No.: PCT/BR2010/000163

§ 371 (c)(1),
(2), (4) Date: Jan. 26, 2012

(87) PCT Pub. No.: WO2010/132968

PCT Pub. Date: Nov. 25, 2010

(65) Prior Publication Data

US 2012/0126923 A1 May 24, 2012

(30) Foreign Application Priority Data

May 19, 2009 (BR) ..... 0903695

(51) Int. Cl.

| | |
|---|---|
| ***H01F 27/30*** | (2006.01) |
| ***H01F 30/12*** | (2006.01) |
| ***H01F 27/10*** | (2006.01) |
| ***H01F 27/08*** | (2006.01) |
| ***H01F 27/26*** | (2006.01) |
| ***H01F 27/28*** | (2006.01) |

(52) U.S. Cl.

USPC ..... 336/196; 336/5; 336/58; 336/60; 336/205; 336/206; 336/210; 336/170; 336/184; 336/185; 336/198

(58) Field of Classification Search

USPC ..... 336/92, 5, 58, 60, 196, 205, 206, 210, 336/170, 184, 198

See application file for complete search history.

(56) References Cited

U.S. PATENT DOCUMENTS 2,403,072 A * 7/1946 Gates ..... 336/5
2,855,576 A * 10/1958 Rohatyn ..... 336/182

(Continued)

FOREIGN PATENT DOCUMENTS

GB 1 087 594 10/1967

OTHER PUBLICATIONS

Written Opinion of International Searching Authority dated Dec. 7, 2010 for Application No. PCT/BR2010/000163.

(Continued)

*Primary Examiner* — Alexander Talpalatski
*Assistant Examiner* — Ronald Hinson
(74) *Attorney, Agent, or Firm* — Alston & Bird LLP

(57) ABSTRACT

It is described a single-phase or three-phase distribution electric transformer, of solid insulation, for use in aerial installation, in poles, in platforms or pedestals, or installation in underground distribution network for operation in air environment, semi-submerged or submerged. Such transformer comprises at least one high voltage winding (3) and at least one low voltage winding (2) concentrically assembled around a core column (1.2,1.3), the low voltage and high voltage windings (2,3) being electrically isolated from a solid material, a core window (20) being defined as a space between two core columns (1.2,1.3), the transformer comprising at least one electrical insulation sheet (4) assembled on at least a core window (20) of said transformer, the assembly of the electrical insulation sheet (4) being defined in the longitudinal direction (300) of the transformer. Such sheet (4) avoids the formation of spiral around the core by immersion water or conductive dust. The use of this dry transformer in the underground distribution networks in the cities offers more safety to the population, because the dry transformer does not explode, apart from eliminating the risk of environmental contamination through the leakage of oil from transformers in oil. Once the dry transformer of the invention does not explode, the underground installation chambers can be simpler and more economic once they do not need to be resistant to explosion.

10 Claims, 7 Drawing Sheets

(56) References Cited

U.S. PATENT DOCUMENTS

| | | | | | |
|---|---|---|---|---|---|
| 3,037,177 | A | * | 5/1962 | Marsh et al. | 336/210 |
| 3,302,149 | A | * | 1/1967 | Forsha | 336/58 |
| 3,579,163 | A | * | 5/1971 | Cronin | 336/94 |
| 3,783,426 | A | * | 1/1974 | Morris et al. | 336/196 |
| 4,095,205 | A | | 6/1978 | Schroeder et al. | |
| 4,173,747 | A | * | 11/1979 | Grimes et al. | 336/60 |
| 5,656,984 | A | * | 8/1997 | Paradis et al. | 336/61 |

OTHER PUBLICATIONS

International Search Report dated Dec. 7, 2010, for Application No. PCT/BR2010/000163.

International Preliminary Report on Patentability dated Sep. 27, 2011 for Application No. PCT/BR2010/000163.

Applicants Response to Written Opinion of International Searching Authority and Article 34 Amendment dated Apr. 25, 2011 for Application No. PCT/BR2010/000163.

* cited by examiner

SUBMERSIBLE DRY DISTRIBUTION TRANSFORMER

CROSS REFERENCE TO RELATED APPLICATIONS

This application is a national stage application, filed under 35 U.S.C. §371, of International Application No. PCT/BR2010/000163, filed May 18, 2010, which is hereby incorporated by reference in its entirety.

BACKGROUND OF THE INVENTION

1. Field of Invention

The present invention refers to a single-phase or three-phase distribution electric transformer, of solid insulation; particularly designed for use in underground or submerse distribution installation or internal or external installation.

2. Description of Related Art

As known in the state of the art, transformers are used in the distribution of electric power to enable the transformation of electric power into currents and voltages suitable for transportation from the generation sites to the consumption regions. For the transmission of electric power over long distances, which can be tens, hundreds or thousands of kilometers, it is a common practice to raise the voltage by means of transformers, so as to reduce the power losses which occur through the electrical resistance of the electrical cables. Transmission of electric power is performed under high voltage, up to near the consumption sites where, also by means of transformers, it is reduced to values suitable for the users' equipments. Such reduction of the voltage level is performed in several stages, by using transformers which are located close to the centers of power consumption. The physical installation of these transformers can be aerial, fastened to poles, or in the ground in internal or external installation or underground installation.

In the cities, it is a common practice to perform the distribution of electric power through an underground distribution network. In the distribution of electric power through an underground network, the transformers are installed in underground chambers. The distribution transformers for underground networks have their own characteristics, which, for instance in Brazil, are defined by ABNT Standard NBR 9369 Underground Transformers Electric and Mechanic Characteristics—Standardization. Other international standards for distribution transformers for underground networks are, for instance, "ANSI C57.12.24-2000, Standard for Transformer-Underground-Type Three-Phase Distribution Transformers, 2500 kVA and Smaller; High Voltage, 34 500 GrdY/19 920 Volts and Below; Low Voltage, 480 Volts and Below-Requirements". Transformers installed in the underground network shall be submersible.

Transformers are classified according to the constructive type into dry transformers and transformers immersed in insulating liquid. Submersible transformers are, in their majority, immersed in insulating liquid, which we will define as oil regardless of its chemical composition. The submersible transformers covered by Brazil's standard have a power range at the rate of 200 kVA to 2500 kVA.

A transformer basically comprises high voltage windings, low voltage windings, iron core for circulation of the magnetic flow, connections among the windings and connection terminals, all of these components lodged inside a metal tank and submerged in oil. Bushings are used to make the link, through the tank, of the internal components to the external connection terminals.

Under the laws of physics, the transformation relation of the transformer is given by the relation of spirals among the windings. The spiral is formed by conductive material around the core, surrounding its circumference. In transformers with insulating liquid, the materials forming the spiral around the core are the winding conductors, the insulating materials of the windings and the insulating oil.

The transformers in insulating liquid have the tank, which contains the active part of the transformer and the insulating oil. The oil acts as an electric insulating element between the parts under tension of the transformer and the tank together with the other materials that get impregnated with oil. The oil also acts as a cooling element, transmitting and transporting the heat produced in the windings and the core, to the cooling surfaces of the tank and of the radiators.

To obtain the required insulation among the parts under tension, insulating materials are used with the suitable spacing, thicknesses and shapes and compatible production process. The way of execution and the type of materials used in the parts under tension depend on the intensity of the electric field foreseen in such points which shall be insulated.

These transformers in oil, although widely used all over the world, present the problems described next.

The insulating oil used, for its chemical condition and although there are several types available of it, is pollutant, to a higher or lower extent, and shall be properly treated so as to not penetrate the soil nor pollute the water table.

Once the active part of the transformer is inside a tank, which is full of oil, the internal pressure of the tank can increase as a result of an internal failure, overcharge or also due to an external failure. The raise in the internal pressure may cause the tank to explode preceded or not by fire, with risk of property and human damages. To reduce the risks, transformers in oil must have safety devices, according to the standards, which can decrease the risks, but not eliminate them.

This type of transformer needs ongoing maintenance, requiring regular inspection, to verify the level of oil and its current condition. Thus, during the verifications, evidencing a reduction in the oil level may indicate the occurrence of leakage. Such reduction in the oil level beyond allowable levels may impair electrical insulation and, consequently, the insulation of the transformer. Any change to the oil characteristics apart from the foreseen ones may indicate the oil degradation, contamination, the admission of humidity or deviation in the operation of the transformer, and may impair its activity.

Transformers submersible in oil shall be installed in underground chambers of special execution, which are costly and have a complex building process, resistant to the transformer explosion and with a system for containment of the transformer's oil.

Dry transformers, once they do not have the oil confined inside a tank, suffer neither this risk of explosion nor the risk of environmental contamination by the transformer's oil should leakage or explosion occur.

Dry distribution transformers, described, for instance, by Brazilian Standard "NBR 10295 Dry Power Transformers" or by international standards such as "IEC 600076 Power Transformers—Part 11 Dry-type" or "IEEE C57.12.01 Standard for General Requirements for Dry-Type Distribution and Power Transformers, Including Those with Solid-Cast and/or Resin Encapsulated Windings" are dry transformers to be installed under shelter.

These transformers shall be protected from the direct action of bad weather such as rain or snow, once they have a supportability limit of the electrical insulation to humidity.

The tolerance level to humidity in dry transformers is defined, for instance, in the previously mentioned Standard IEC, classified in this standard into "Classes" C1, C2 and C3. Installation shall be internal, inside buildings or cubicles.

The transformer's tolerance to humidity and to the surrounding air pollution is obtained by the transformer's constructive model, the materials used, manufacturing process and electrical distances, which provide the transformer with its characteristics of electrical insulation, in humid or polluted environments.

The insulation of the windings is formed by solid insulation and air. Thus, the air characteristics participate in determining the transformer's insulating level. The air may contain humidity and solid particles under suspension. Both the humidity and the solid particles under suspension, which can be metallic or not, change the insulating characteristics.

Depending on the characteristics of the place of installation, the humidity level and the solid particles under suspension, it is possible to choose the class which the dry transformer shall fit, considering the foreseen periods of maintenance and cleaning.

The current dry power transformers shall be installed in sheltered places. They usually have the high voltage windings, the low voltage windings and the core all separated. This separation among the windings and also between the windings and the core serves to insulate the parts and also acts as cooling. The spacing among windings or between the windings and the core will be called cooling channels. Cooling is necessary to dissipate the losses generated in the windings and core and to restrict the temperature to that established in the project and standards according to the thermal class of the insulating materials used. The circulation of air through the cooling channels and the surface of the windings and core makes it possible to dissipate the losses of the parts to the surrounding air. The capacity of dissipating the losses within a temperature level establishes a limit for the transformer power.

In dry power transformers, the materials that form the spiral around the core, surrounding it in its circumference, are the winding conductors, the insulating materials of the windings, the environment air and the materials deposited on the surface of the windings. In case of condensation and excessive pollution, such as ore dust or saline environment, the set of materials deposited on the surface of the windings or suspended in the air can become electrically conductive and spiral can be formed, causing the circulation of currents and losses.

Additionally, the insulating task of the air gets impaired with the presence of humidity and solid particles. For this reason, the currently available dry power transformers shall be installed in sheltered places, and the tolerance limits to humid or polluted environments shall be established in classes, for instance, pursuant to Standard IEC 60076-11.

In the current dry power transformers, the air surrounding the windings has also the role of insulation because the external surface of the windings is at a certain potential in relation to the ground. The windings are a part alive and, for this reason, shall be installed in compliance with the electrical distances pursuant to the manufacturer's instruction and standards, and they cannot be touched when energized.

For external installation, there are dry transformers for measuring voltage or current which are completely encapsulated with solid insulation. External air can participate in the insulation or not, depending if it uses a bushing-type terminal or one connectable to a "plug-in" cable. The windings may have external shield that may be grounded or not. The thermal dissipation of these transformers is performed by the external surface itself.

There are dry power transformers for buried or submersible use, which are completely encapsulated, for little individual powers at the rate of up to 50 kVA with one phase, or 100 kVA with three phases. The thermal dissipation of these transformers is performed by the external surface itself, which limits the transformer power.

These measuring transformers or power transformers, once they are completely encapsulated in resin, have limitations in dissipating the heat of the losses generated in the windings and in the core, and, for this reason, are manufactured only for short powers. They can have grounded external shield, which occasionally allows them to be installed in external or submerse environments; however, their power is limited to the rate of 100 kVA.

One prior art in this field is disclosed by U.S. Pat. No. 4,095,205. According to that solution, a transformer with solid insulating structures, those insulating structures including polyethylene terephthalate film which is surrounded on each of its major outer surfaces by a layer of paper. This solution however does not provide a transformer that can be used in submersible situation and avoiding the conductive spiral.

BRIEF DESCRIPTION

The present invention aims at supplying a dry power transformer for installation in submersible and underground distribution networks. The dry transformer of the invention has an electrical insulation system independent on the environment surrounding the transformer, whereas the thermal cooling system allows the dry power transformer of the invention to be manufactured with a power of up to some tens of thousands KVA.

Such goal is achieved by the supply of a submersible dry distribution transformer, comprising at least one high voltage winding and at least one low voltage winding concentrically assembled around a core column, the low voltage and high voltage windings being electrically insulated from a solid material, a core window being defined as a space between two core columns, the transformer comprising at least one electrical insulation sheet assembled on at least a core window of said transformer, the assembly of the electrical insulation sheet being defined in the longitudinal direction of the transformer.

The goal of the invention is a dry transformer which is submersible because it has an insulation system that performs the interruption of the spiral around the core formed by immersion water.

Thus, the goals of the present invention are also achieved by supplying a submersible dry distribution transformer, comprising at least one high voltage winding and at least one low voltage winding concentrically assembled around a core column, comprising at least one electrical insulation sheet configured to block the passage of a liquid, particularly water, and the formation of a conductive spiral when the transformer is submerged, from a transformer first side to a transformer second side, these being equally spaced, and at opposite directions, from the longitudinal axis of the transformer.

Additionally, the transformer has windings with solid insulation and may have grounded shield. The core and the metal parts exposed are protected from corrosion by a suitable painting system.

BRIEF DESCRIPTION OF THE FIGURES

The present invention will be described next, in more details, based on figures.

DETAILED DESCRIPTION OF VARIOUS EMBODIMENTS

Figure 1:
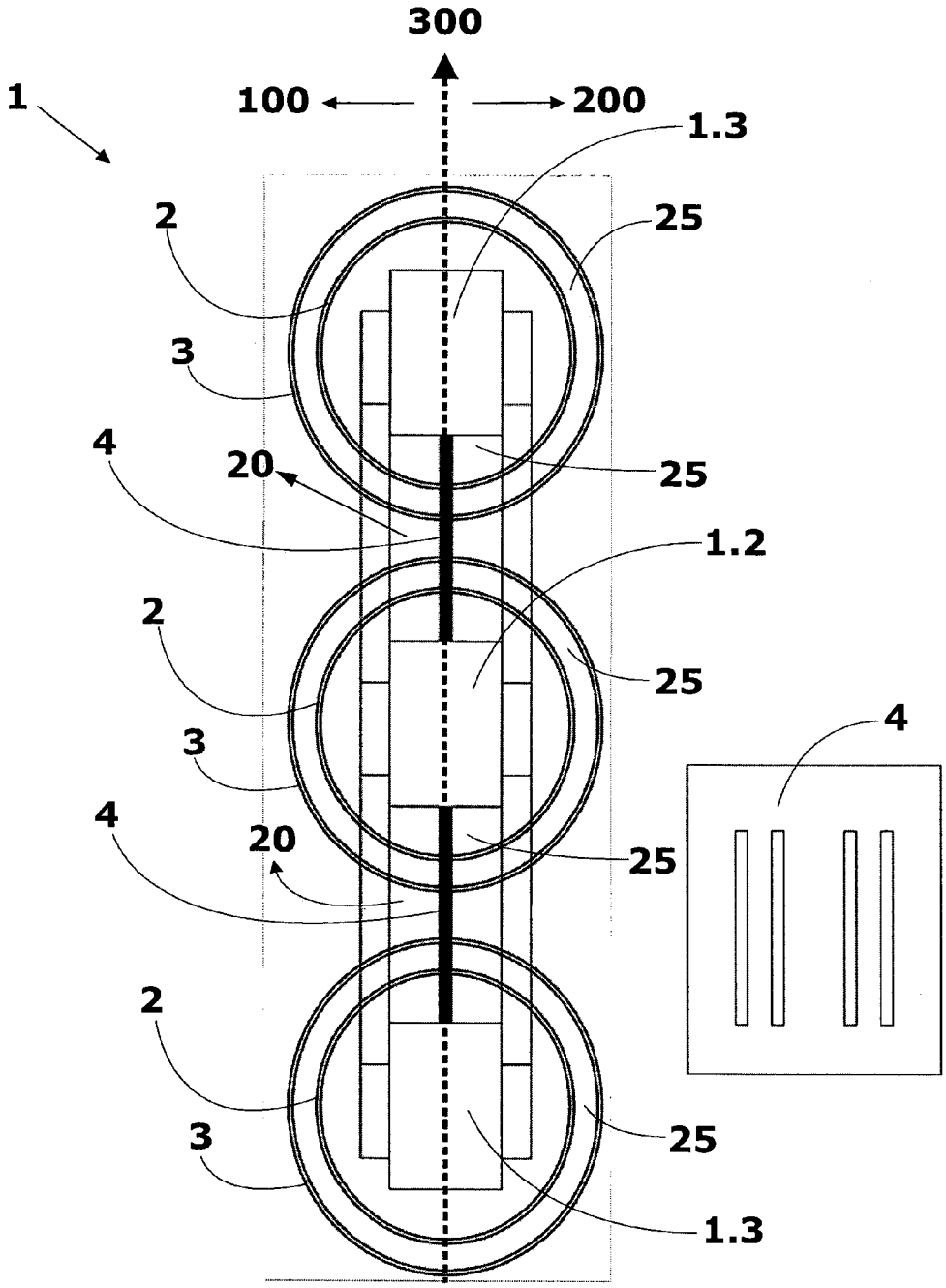
FIG. 1—represents a floor view of the submersible dry transformer, comprised by an insulation system which performs the interruption of the water spiral around the core, according to the teachings of the present invention (detail of the system for interrupting the water spiral around the core)

FIG. 1 shows a floor view of the submersible dry transformer, comprised by an insulation system, according to the teachings of the present invention.

Said distribution transformer comprises at least one high voltage winding 3 and at least one low voltage winding 2 concentrically assembled around a core column, or core legs 1.2, 1.3.

FIG. 1 illustrates, for instance, a three-phase transformer formed by a three-phase core, by three low voltage windings 2 and three high voltage windings 3.

In the case of the three-phase transformer, it is noted, based on FIGS. 1, 4 to 7 that said core is formed by portions of higher core and lower core 1.1, and by the core central columns 1.2 and core side columns 1.3. It is worth mentioning that this three-phase transformer embodiment is the preferred one for the application of the object proposed herein.

The low voltage windings 2, also called internal windings, and the high voltage windings 3, called external windings, are electrically insulated from a solid material, being also possible to note the existence of a core window 20 defined as a space between two core columns 1.2, 1.3. Differently, it is possible to say that the core window 20 is defined as the space formed by the central column, or leg of the core 1.2, and the side columns, or legs of the core 1.3 at the height of the core legs 1.2 e 1.3.

In each core leg 1.2 and 1.3, a set of coils is assembled, which is formed by the inner coils 2 and outer coils 3 each outer coil being connected to its neighbor outer coil by means of two winding terminals 5 and two electric cables 5'.

A very innovative characteristic of the present invention refers to the fact that the proposed distribution transformer comprises at least one electrical insulation sheet 4 assembled on at least a core window 20 of said transformer, so that the assembly of the electrical insulation sheet 4 is defined in the longitudinal direction 300 of the transformer.

Figure 2:
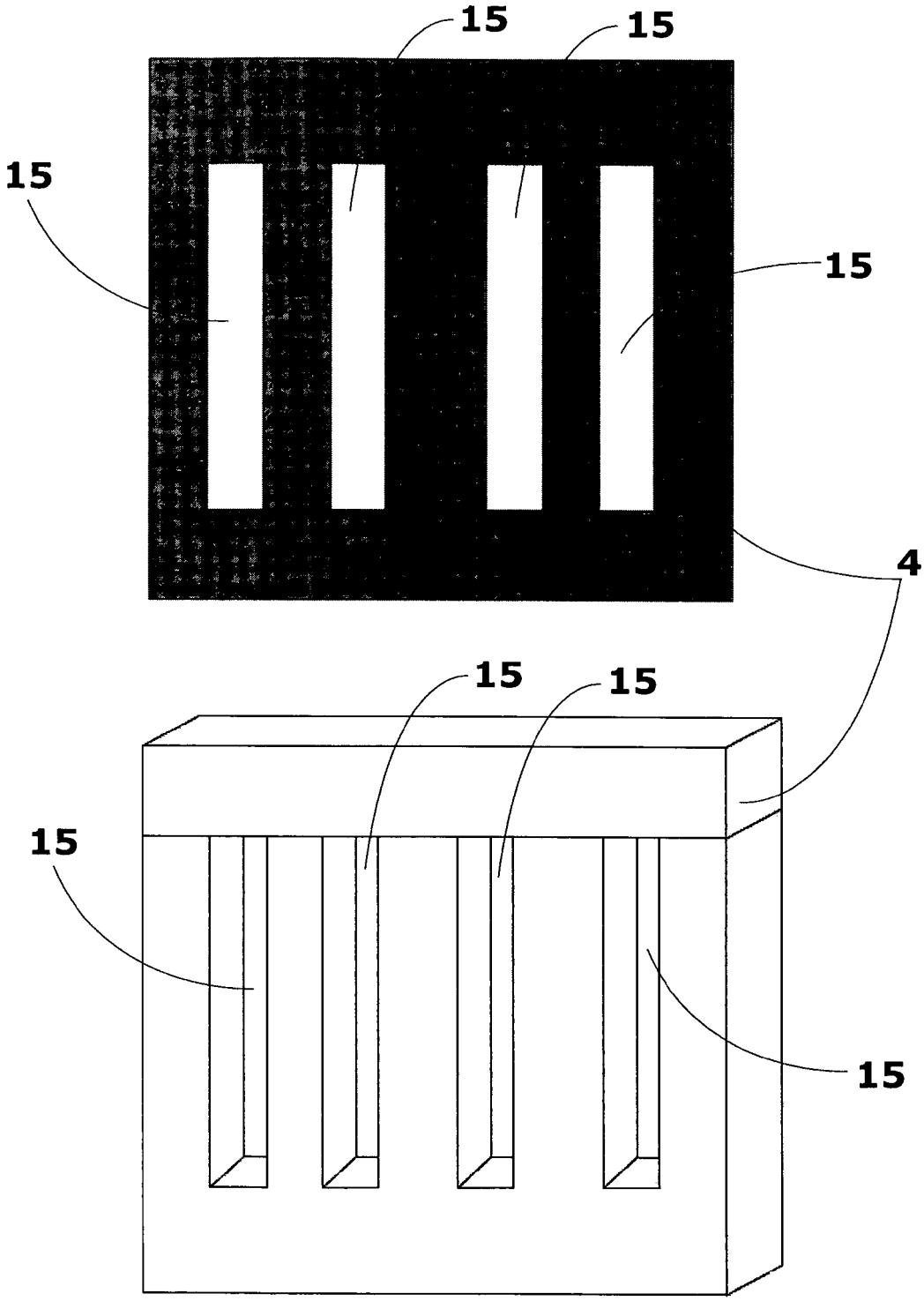
FIG. 2—represents a view of the electrical insulation sheet, or insulation system, according to the object of the present invention.
Figure 6:
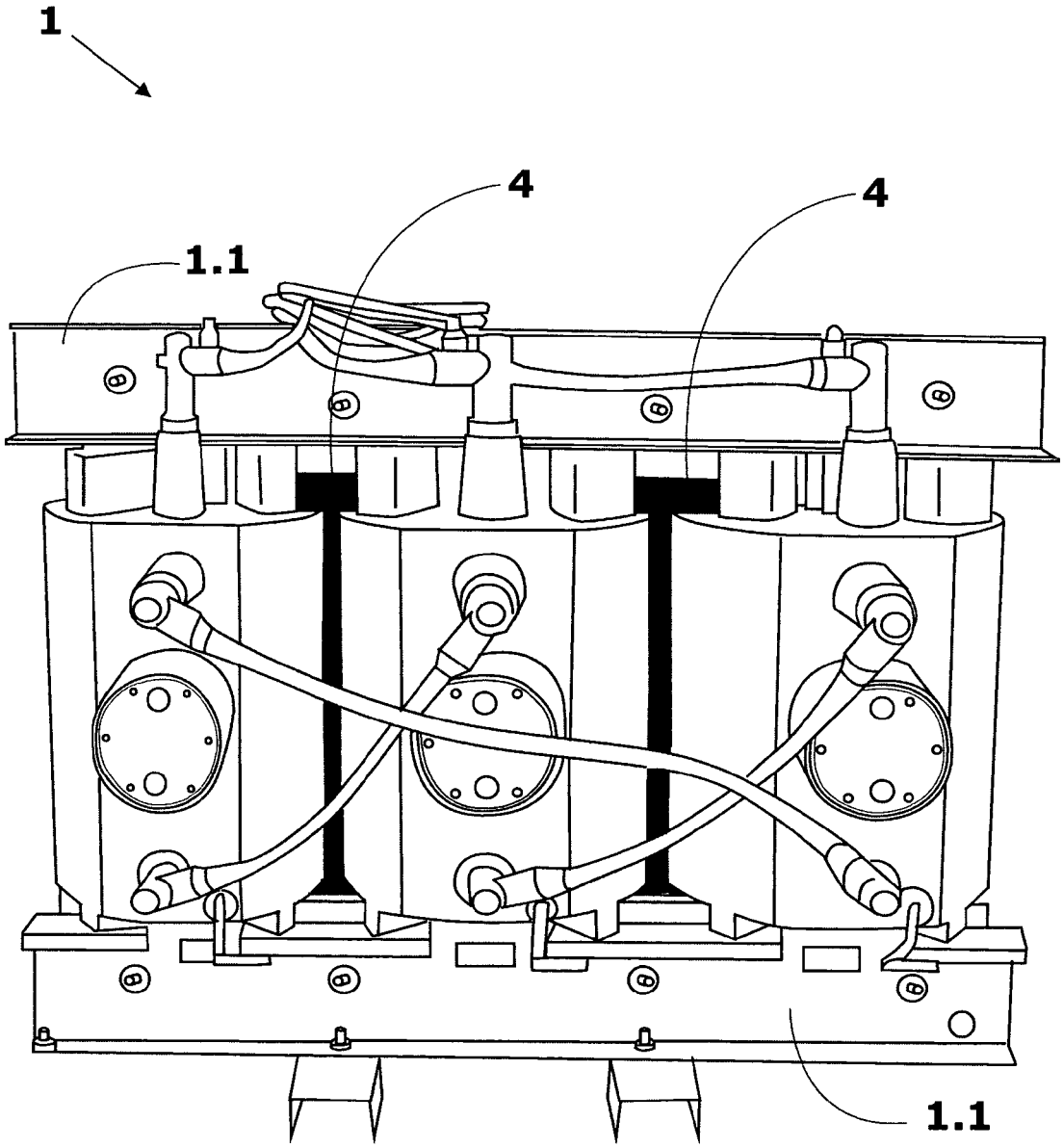
FIG. 6—represents a front view of a three-phase submersible dry transformer, highlighting the electrical insulation sheet, according to the object of the present invention.
Figure 7:
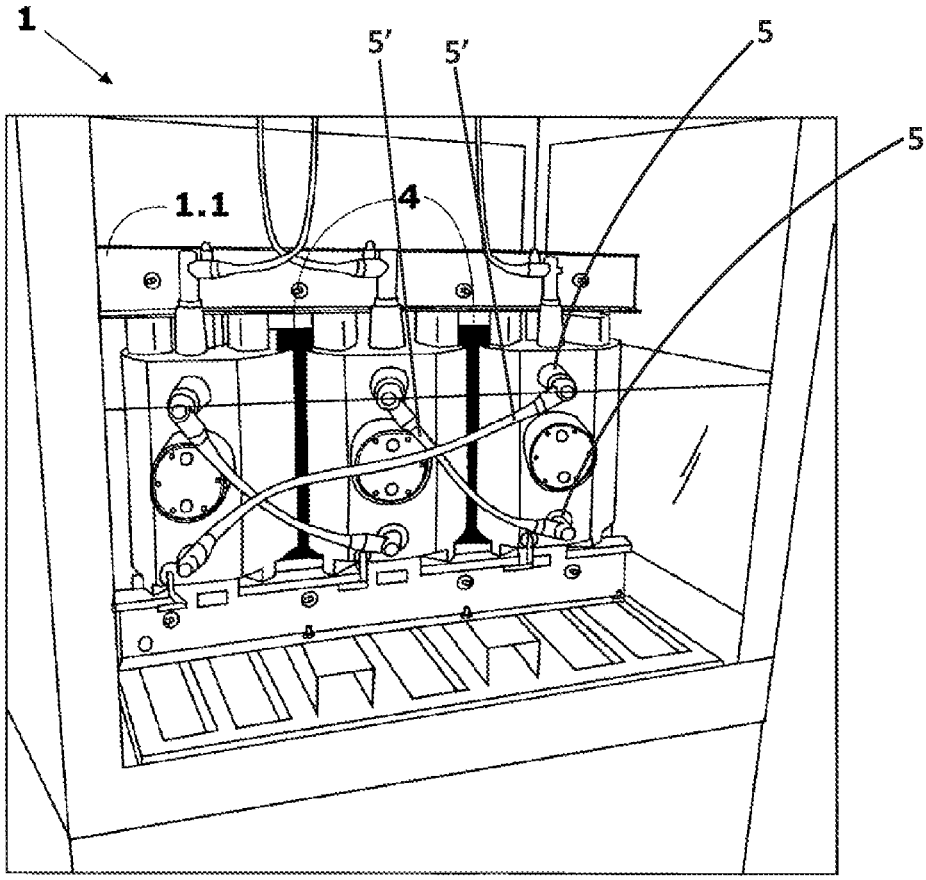
FIG. 7—represents a second perspective view of a three-phase submersible dry transformer, highlighting the electrical insulation sheet when the machine is submerged.

FIGS. 1, 6 and 7 show in more details the assembly of said electrical insulation sheet 4, according to the teachings of the present invention. FIG. 2 further illustrates a relevant constructive aspect of the insulation sheet 4, object of the present intention, directed to the channels of passage 15 of the low voltage 2 and high voltage windings 3.

Such channels 15 allow the passage of the low voltage 2 and high voltage windings 3 through the structure of the insulation sheet 4.

Figure 4:
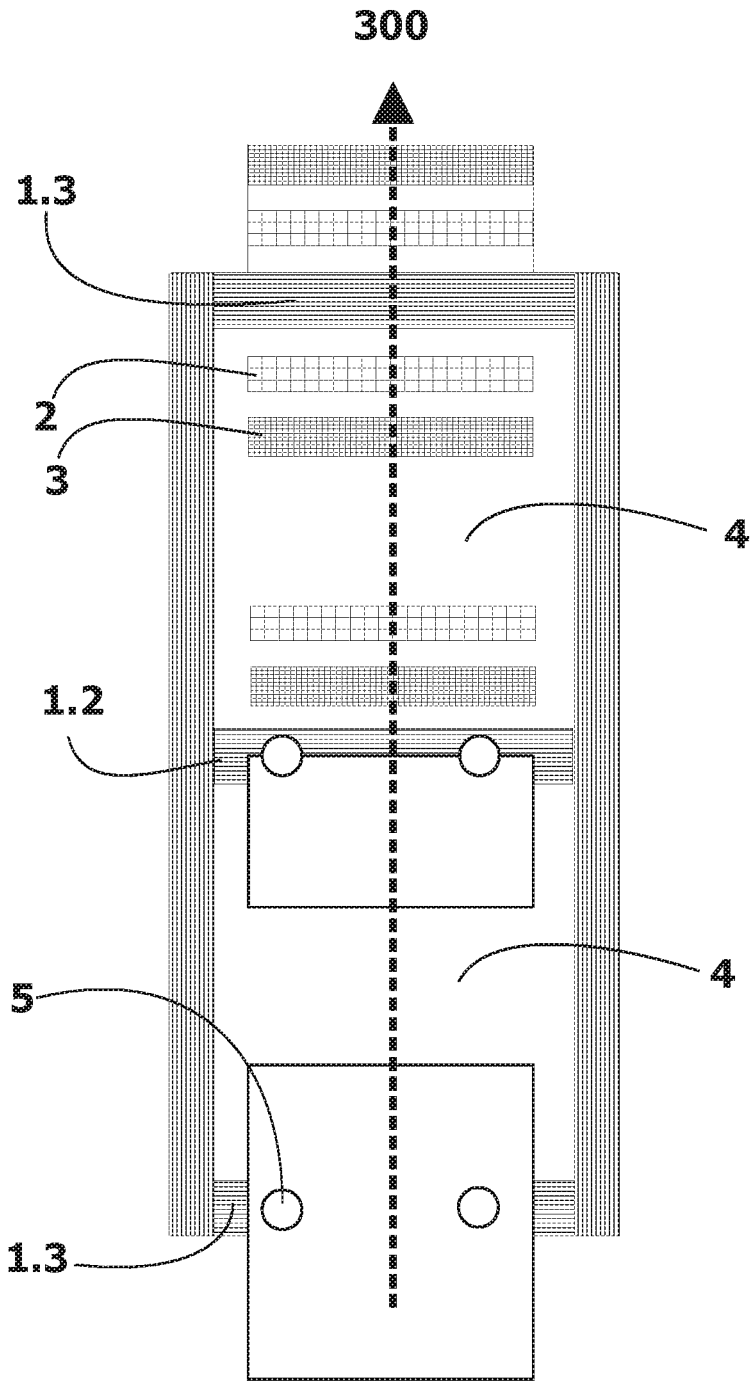
FIG. 4—represents a side view of a three-phase submersible dry transformer, comprised by an insulation system, or electrical insulation sheet, which performs the interruption of the water spiral around the core. Side sectional view of the half, showing core, high voltage windings, low voltage windings and system for interrupting the water spiral around the core.
Figure 5:
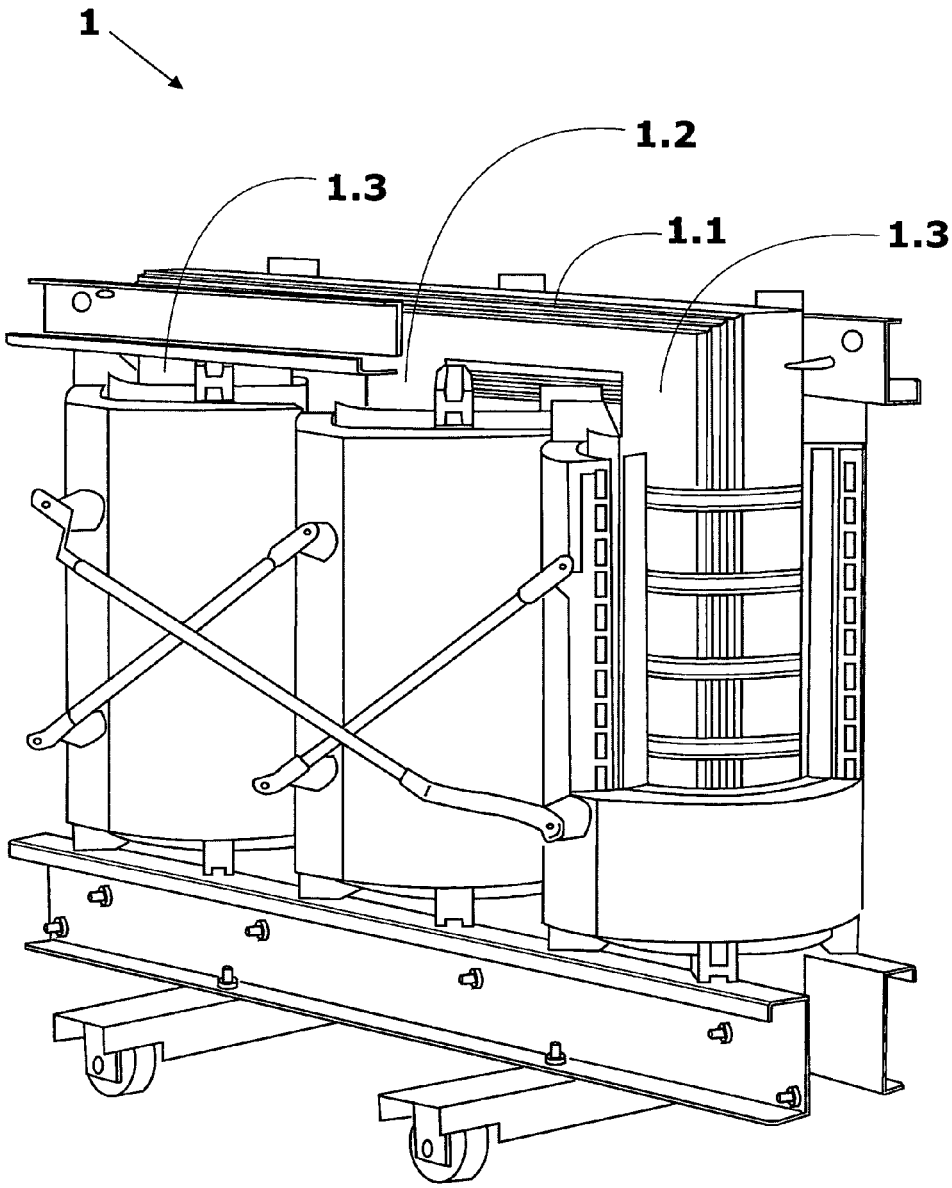
FIG. 5—represents a perspective view of a three-phase dry conventional transformer, not submersible.

On the other hand, it is possible to state that the assembly of the electrical insulation sheet 4 defines a transformer first side 100 and a transformer second side 200, equally spaced, and at opposite sides, from the longitudinal axis 300 of the transformer, as illustrated by FIGS. 1*e*4.

Said electrical insulation wall 4 is then configured so as to electrically insulate the transformer first side 100 from the transformer second side 200 when the transformer is submerged. FIG. 7 shows a second perspective view of a three-phase submersible dry transformer, highlighting the electrical insulation sheet 4 when said machine is submerged. It is possible to state that the electrical insulation sheet 4 encompasses the space of the core window 20 which is not occupied by the windings, or coils.

In other words, it is possible to say that the insulation sheet 4 consists of a solid dividing wall, between the left side and the right side of the distribution transformer.

FIG. 1 shows an additional innovative characteristic of the object proposed herein, especially designed to allow the dry transformer to be manufactured at powers of up to some tens of thousands KVA. Such characteristic is targeted for the use of cooling channels 25, which are defined as spaces that exist between the low voltage and high voltage windings 2,3, between said windings and the core column 1.2, 1.3 and within the windings 2,3.

The advantages offered by the transformer of the present invention, compared to the prior arts for submersible transformers, include the use of said cooling channels 25, which allow the machine to operate under powers at the rate of 500 KVA to 2 MVA, when submerged in water, without the need of a protective cubicle.

Also regarding the electrical insulation wall 4, this is preferably comprised by insulating material made of resin and glass fiber, so that the foreseen goals are achieved. Anyway, other materials, with similar characteristics, may be employed in the construction of said sheet 4 without impairing its function.

It is worth mentioning that the electrical insulation wall 4, according to the teachings of the present invention, is preferably sealed to the low voltage and high voltage windings 2,3 using silicone material. However, other methods can be used in order to seal the windings on the insulation wall 4, as proposed.

Also quite preferably, the electrical insulation wall 4 is formed by a sheet which is 4 mm thick.

It is worth highlighting that the electrical insulation sheet 4 is applied both to a three-phase transformer and to a single-phase transformer. On the other hand, as already mentioned, the present invention is preferably aimed at a three-phase distribution transformer.

On the other hand, it is possible to say that the submersible dry distribution transformer comprises at least one high voltage winding 3 and at least one low voltage winding 2 concentrically assembled around a core column 1.2, 1.3, in a way that said transformer comprises at least one electrical insulation sheet 4 configured to block the passage of a liquid, and the formation of a conductive spiral, when the transformer is submerged.

In this case, said insulation sheet 4 prevents the conductive spiral from circulating from a transformer first side 100 to a transformer second side 200, which are equally spaced, and at opposite directions, from the longitudinal axis 300 of the transformer, trough the core window 20, when the transformer is submerged.

Figure 3:
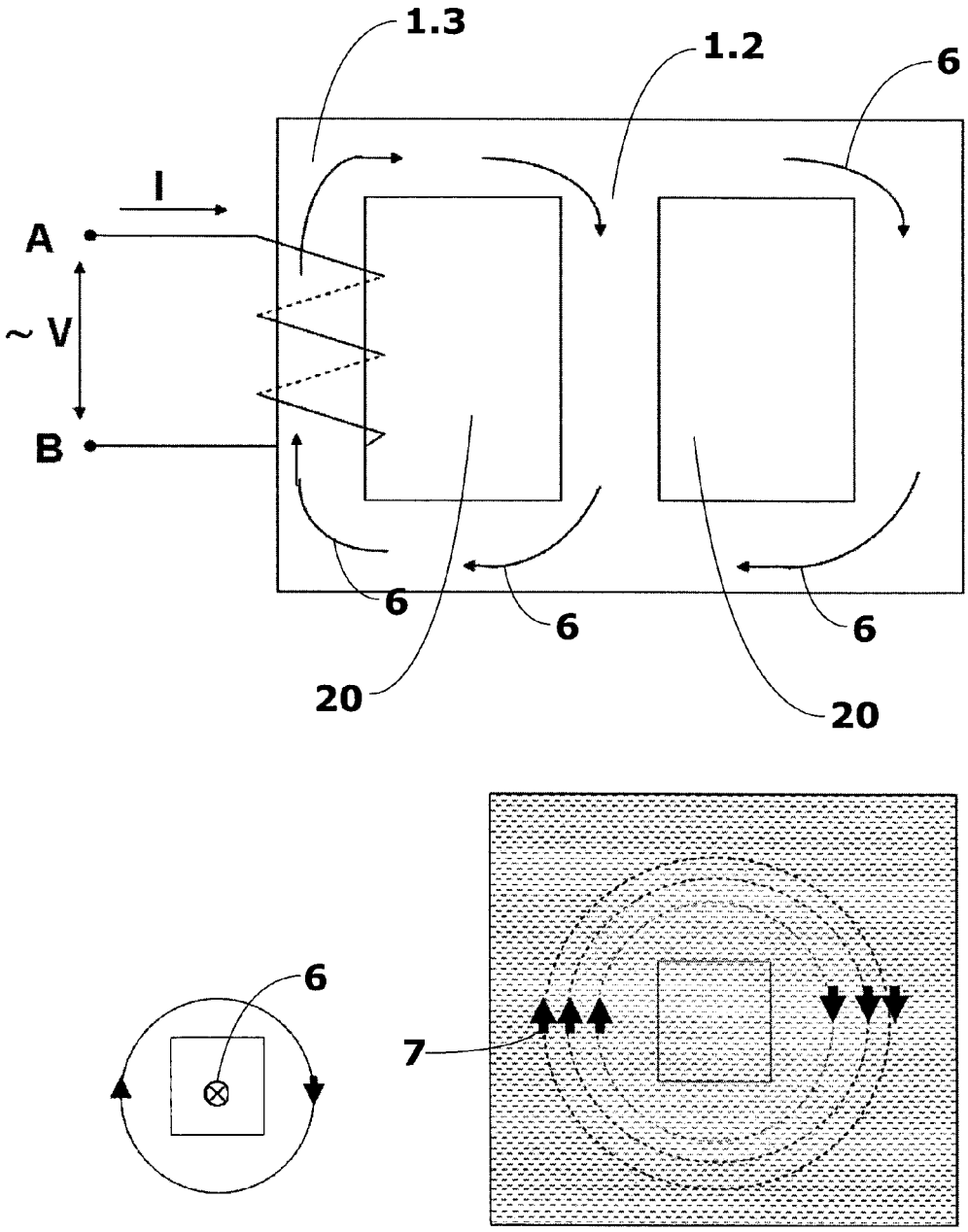
FIG. 3—represents a schematic view of a transformer three-phase core and figures describing the electromagnetic phenomenon of spiral around the core.

FIG. 3 shows a circulation of electric currents 7 around the core, if the solution proposed in the present invention is not applied; in other words, if the electrical insulation sheet 4 is not used.

The same FIG. 3 shows the magnetic flow 6 generated in the core of the transformer when its winding is connected to the alternating current power supply.

Such magnetic flow 6, circulating in the transformer's core 1.1/ 1.2/1.3, induces an electrical voltage in the spirals around the core.

For the spiral formation, it is necessary the presence of an electrical conductor material around the core. On the other hand, dirty water and with residues is an electrical conductor. This way, the installation of the electrical insulation sheet 4, according to the object proposed herein, interrupts the spiral formed by the water which is around the core.

Such insulation system, formed by the sheet 4, is indispensable to prevent the spiral formation by water, and upon its interruption, it is possible to also avoid the circulation of parasite electric currents 7 around the core 1.1/1.2/1.3, and losses of electric power which would help reduce the transformer power.

Therefore, as previously commented, the use of the electrical insulation sheet 4, according to the object of the present invention, allows the transformer to operate at powers quite higher than those available in the state of the art today.

Furthermore, the arrangement of the power transformer, as proposed, has the advantage—compared to transformers submersible in oil—of not exploding, apart from being self-extinguishable in case of fire, which allows it to be installed in underground chambers of simpler and more economic execution, whereas minimizing personal risks and material costs.

An additional advantage of the distribution transformer of the present invention refers to the fact that it is free from insulating oils, which could contaminate the environment, such as the water table should leakage occur, during the transportation or during the operation of the transformer. Thus, the underground chambers for the installation of the submersible transformers proposed in the invention herein can be executed in a more economic and simpler manner, once they do not require a system for oil containment, in case of leakage or explosion.

After describing an example of preferred embodiment, it shall be understood that the scope of the present invention encompasses other possible variations, being limited only by the contents of the attached claims, where the possible equivalents are included.

The invention claimed is:

1. Submersible dry distribution transformer, the transformer comprising:

at least two high voltage windings and at least two low voltage windings, each concentrically assembled around a respective one of at least two core columns, the low voltage and high voltage windings each being electrically isolated from each other by a solid material;

at least one core window defined as a space extending substantially between external surfaces of the at least two core columns and through the low voltage and high voltage windings;

at least one solid electrical insulation sheet assembled on the at least one core window of the transformer, the assembly of the electrical insulation sheet being defined in the longitudinal direction of the transformer such that the electrical insulation sheet substantially encompasses the space of the at least one core window and extends through the low voltage and high voltage windings.

2. Transformer according to claim 1, wherein the assembly of the electrical insulation sheet defines a transformer first side and a transformer second side equally spaced, and at opposite directions, from the longitudinal axis of the transformer, the electrical insulation sheet being configured to electrically insulate the transformer first side from the transformer second side, through the core window, when the transformer is submerged.

3. Transformer according to claim 1, further comprising cooling channels defined as spaces between the low and high voltage windings, between said windings and the core column, and within the windings.

4. Transformer according to claim 3, wherein the electrical insulation sheet is comprised by an insulating material made of resin and glass fiber.

5. Transformer according to claim 1, wherein the electrical insulation sheet is sealed to the low and high voltage windings using silicone material.

6. Transformer according to claim 1, wherein the electrical insulation sheet is formed by a sheet which is 4 mm thick.

7. Transformer according to claim 1, wherein the transformer is a single-phase transformer.

8. Transformer according to claim 1, wherein the transformer is a three-phase transformer.

9. Submersible dry distribution transformer, the transformer comprising:

at least one high voltage winding and at least one low voltage winding concentrically assembled around a core column;

at least one core window defined as a space extending substantially between an external surface of the core column and through the at least one high voltage winding;

at least one electrical insulation sheet assembled on the at least one core window and substantially encompassing the space defined thereby, said at least one electrical insulation sheet being configured to extend through the at least one high voltage winding and to block passage of a liquid through the at least one window core when the transformer is submerged, from a transformer first side to a transformer second side, these being equally spaced, and at opposite directions, from the longitudinal axis of the transformer.

10. Transformer according to claim 9, wherein the liquid is water.

* * * * *